US010526848B2

(12) United States Patent
Lin et al.

(10) Patent No.: US 10,526,848 B2
(45) Date of Patent: Jan. 7, 2020

(54) CUTTING STRUCTURE OF A DOWNHOLE CUTTING TOOL

(71) Applicant: Schlumberger Technology Corporation, Sugar Land, TX (US)

(72) Inventors: Yuanbo Lin, Houston, TX (US); Youhe Zhang, Spring, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 325 days.

(21) Appl. No.: 15/308,211

(22) PCT Filed: Apr. 13, 2015

(86) PCT No.: PCT/US2015/025577

§ 371 (c)(1),
(2) Date: Nov. 1, 2016

(87) PCT Pub. No.: WO2015/167786

PCT Pub. Date: Nov. 5, 2015

(65) Prior Publication Data

US 2017/0058610 A1 Mar. 2, 2017

Related U.S. Application Data

(60) Provisional application No. 61/986,991, filed on May 1, 2014.

(51) Int. Cl.

| | |
|---|---|
| ***E21B 10/26*** | (2006.01) |
| ***E21B 7/28*** | (2006.01) |
| ***E21B 10/32*** | (2006.01) |
| ***E21B 10/55*** | (2006.01) |

(52) U.S. Cl.
CPC ..... *E21B 10/32* (2013.01); *E21B 7/28* (2013.01); *E21B 10/322* (2013.01); *E21B 10/55* (2013.01)

(58) Field of Classification Search
CPC ..... E21B 10/26; E21B 10/32; E21B 10/322; E21B 10/325
See application file for complete search history.

(56) References Cited

U.S. PATENT DOCUMENTS

| | | | | |
|---|---|---|---|---|
| 6,206,117 | B1 * | 3/2001 | Tibbitts | E21B 10/26 175/399 |
| 2007/0089912 | A1 | 4/2007 | Eddison et al. | |
| 2007/0205023 | A1 | 9/2007 | Hoffmaster et al. | |
| 2009/0032309 | A1 | 2/2009 | Schwefe et al. | |
| 2010/0276208 | A1 | 11/2010 | Sue | |
| 2011/0024194 | A1 * | 2/2011 | Servaes | E21B 7/28 175/57 |
| 2013/0146361 | A1 | 6/2013 | Makkar et al. | |

OTHER PUBLICATIONS

International Search Report and Written Opinion for International Application No. PCT/US2015/025577, dated Jul. 17, 2015, 12 pages.

* cited by examiner

*Primary Examiner* — Robert E Fuller

(57) ABSTRACT

A downhole cutting apparatus includes a tubular body and a cutter block extending radially therefrom. The cutter block includes at least one row of cutting elements. The row or cutting elements defines a cutting profile having a first underreaming cutting edge, a second underreaming cutting edge, and a first backreaming cutting edge between the first underreaming cutting edge and the second underreaming cutting edge.

21 Claims, 7 Drawing Sheets

CUTTING STRUCTURE OF A DOWNHOLE CUTTING TOOL

CROSS-REFERENCE TO RELATED APPLICATIONS

This application claims the benefit of, and priority to, U.S. Patent Application Ser. No. 61/986,991, filed on May 1, 2014 and entitled "Downhole Cutting Structure," which application is expressly incorporated herein by this reference.

BACKGROUND

Referring to FIG. 1A, one example of a system for drilling an earth formation is shown. The drilling system includes a drilling rig 10 used to turn a drilling tool assembly 12 that extends into a well bore 14. The drilling tool assembly 12 includes a drill string 16, and a bottomhole assembly (BHA) 18, which is attached to the distal end of the drill string 16. The "distal end" of the drill string is the end furthest from the drilling rig 10.

The drill string 16 includes several joints of drill pipe 16*a* connected end-to-end through tool joints 16*b*. The drill string 16 is used to transmit drilling fluid (through its hollow core) and to transmit rotational power from the drilling rig 10 to the BHA 18. In some cases the drill string 16 further includes additional components such as subs, pup joints, etc.

The BHA 18 includes a drill bit 20. A BHA may also include additional components attached between the drill string 16 and the drill bit 20. Examples of additional BHA components include drill collars, stabilizers, measurement-while-drilling (MWD) tools, logging-while-drilling (LWD) tools, subs, hole enlargement devices (e.g., hole openers and reamers), jars, thrusters, downhole motors, and rotary steerable systems.

In the drilling of oil and gas wells, concentric casing strings are installed and cemented in the well bore as drilling progresses to increasing depths. Each new casing string may run from the surface or may include a liner suspended from a previously installed casing string. The new casing string may be within the previously installed casing string, thereby limiting the annular area available for the cementing operation. Further, as successively smaller diameter casing strings are used, the flow area for the production of oil and gas is reduced. To increase the annular space for the cementing operation, and to increase the production flow area, it may be desirable to enlarge the well bore below the terminal end of the previously cased portion of the well bore. By enlarging the well bore, a larger annular area is provided for subsequently installing and cementing a larger casing string than would have been possible otherwise. Accordingly, by enlarging the well bore below the previously cased portion of the well bore, comparatively larger diameter casing may be used at increased depths, thereby providing more flow area for the production of oil and gas.

Various methods have been devised for passing a drilling assembly through an existing cased portion of a well bore and enlarging the well bore below the casing. One such method is the use of an underreamer, which has basically two operative states—a closed, retracted, or collapsed state, where the diameter of the tool is sufficiently small to allow the tool to pass through the existing cased portion of the well bore, and an open or expanded state, where arms with cutters on the ends thereof extend from the body of the tool. In this latter position, the underreamer enlarges the well bore diameter as the tool is rotated and lowered in the well bore.

SUMMARY

According to one aspect of the disclosure, there is provided a downhole cutting apparatus including a cutter block having a first row of cutting elements positioned along at least one first surface. The first row or cutting elements may define a first underreaming cutting edge, a second underreaming cutting edge, and a first backreaming cutting edge between the first underreaming cutting edge and the second underreaming cutting edge. In at least some embodiments, the cutter block may be coupled to a tubular body, and the cutter blocks may be fixed at a radial position, or extendable between radially retracted or extendable positions.

According to another aspect of the disclosure, there is provided a method of drilling a well bore. The method may include tripping a drilling tool assembly into a well bore. The drilling tool assembly may include a drill bit and a downhole cutting apparatus having a cutter block with a row of cutting elements arranged along first and second underreaming cutting edges. A first portion of the well bore may be drilled with the drill bit, and a second portion of the well bore may be drilled with the downhole cutting apparatus. Optionally, drilling the second portion of the well bore may include expanding a diameter of a portion of the well bore beyond a diameter drilled with the drill bit.

According to another aspect of the disclosure, there is provided a method of manufacturing a cutter block. The method may include forming a cutter block body with a first row of cutting element pockets along a first underreaming cutting edge, a second underreaming cutting edge, and a first backreaming cutting edge. The first backreaming cutting edge may be between the first and second underreaming cutting edges. The method may also include coupling a plurality of cutting elements to the cutter block body. Coupling the plurality of cutting elements to the cutter block body may include positioning the plurality of cutting elements within the first row of cutting element pockets.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Figure 1A:
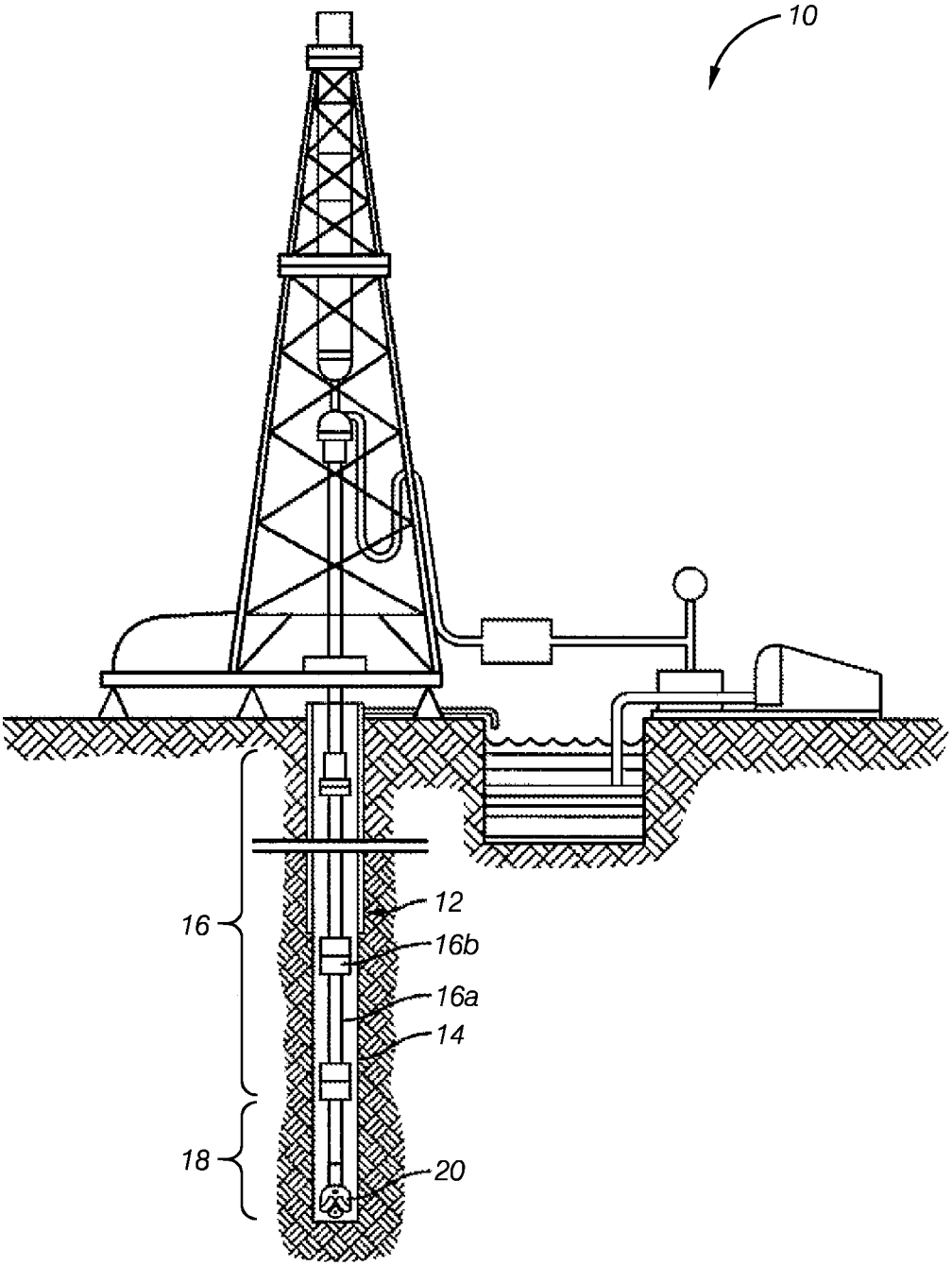
Fig. 1A (Prior Art)
FIG. 1A is a schematic representation of a drilling operation.

In one aspect, embodiments disclosed herein relate generally to cutting structures for use on drilling tool assemblies. More specifically, some embodiments disclosed herein relate to cutting structures for a downhole tool such as a reamer (e.g., underreamer). In some embodiments, the cutting structure may have a row of cutting elements having a first underreaming cutting edge, a second underreaming cutting edge, and a first backreaming cutting edge between the first and second underreaming cutting edges.

The embodiments disclosed should not be interpreted, or otherwise used, as limiting the scope of the disclosure, including the claims to the specific arrangement or features in the disclosed embodiment. Rather, each embodiment may be altered in any number of manners while remaining within the scope of the present disclosure, including by combining features of different embodiments disclosed herein. In addition, those skilled in the art will appreciate that the following description has broad application, and the discussion of any embodiment is meant to be illustrative of that embodiment, and not intended to suggest that the scope of the disclosure, including the claims, is limited to that embodiment.

Certain terms are used throughout the following description and claims to refer to particular features or components. As those skilled in the art will appreciate, different persons may refer to the same feature or component by different names. This document does not intend to distinguish between components or features that differ in name but not function. The figures should be considered as being to scale for some embodiments and not to scale for other embodiments. Further, certain features and components in the drawings may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to." Also, the term "couple," "couples," "connects", "connected", "attach", "attaches", "secures", "secured to", and the like are intended to include either an indirect or direct connection, as well as an integral connection. Thus, if a first component is coupled to a second component, that connection may be through a direct connection, or through an indirect connection via other components, devices, and connections.

Reference to up or down will be made for purposes of description with "up", "upper", "uphole", or "upstream" meaning toward the earth's surface or toward the entrance of a well bore; and "down", "lower", "downhole", or "downstream" meaning away from the earth's surface or toward the bottom or terminal end of a well bore.

According to some aspects of the present disclosure, there is provided a downhole cutting apparatus, which may include a tubular body having a longitudinal axis, and a cutter block having a row of cutting elements. The row of cutting elements may include a first underreaming cutting edge, a second underreaming cutting edge, and a first backreaming cutting edge between the first and second underreaming cutting edges. In one or more embodiments, the downhole cutting apparatus may be a downhole cutting tool that is not expandable. For example, in one or more embodiments, the downhole cutting apparatus may be a hole opener or reamer having a cutter block that is fixed or which otherwise does not expand radially. In one or more embodiments, the downhole cutting apparatus may be an expandable tool and the cutter block may be radially extendable from the tubular body.

Figure 1B:
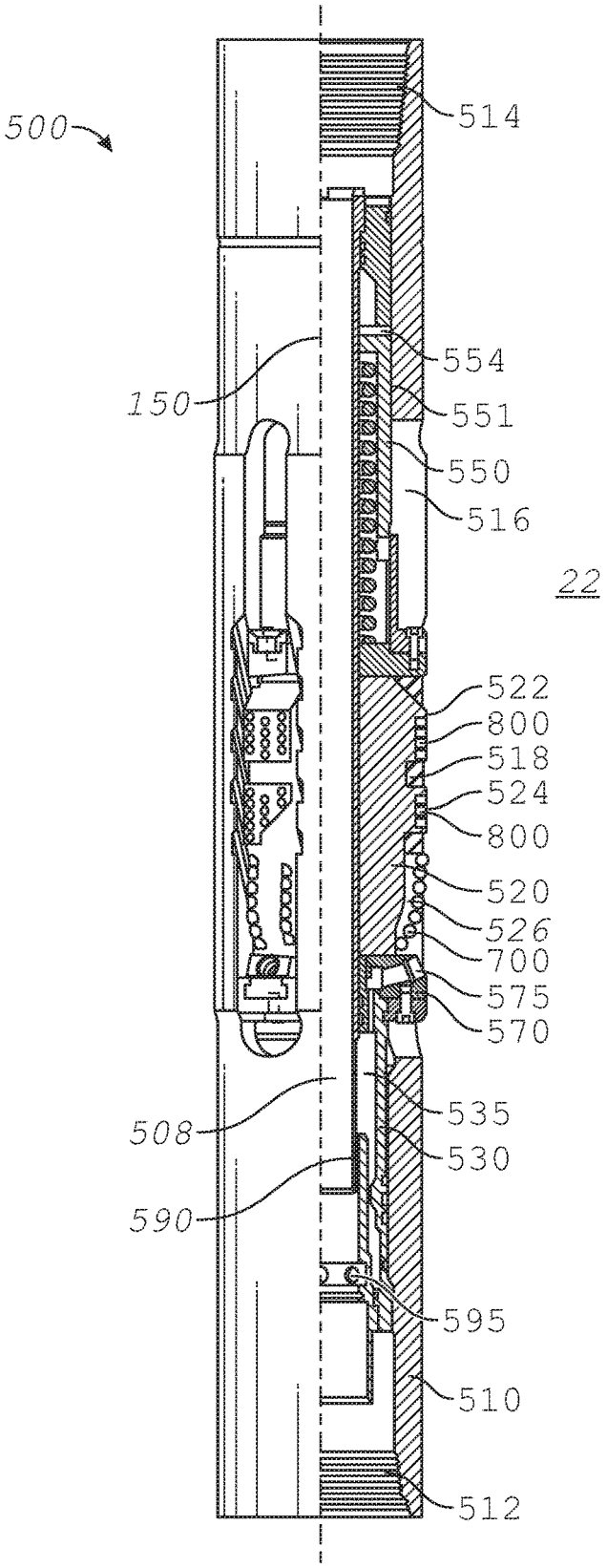
FIGS. 1B and 1C are partial cut-away views of an expandable cutting structure, in accordance with embodiments disclosed herein.
Figure 1C:
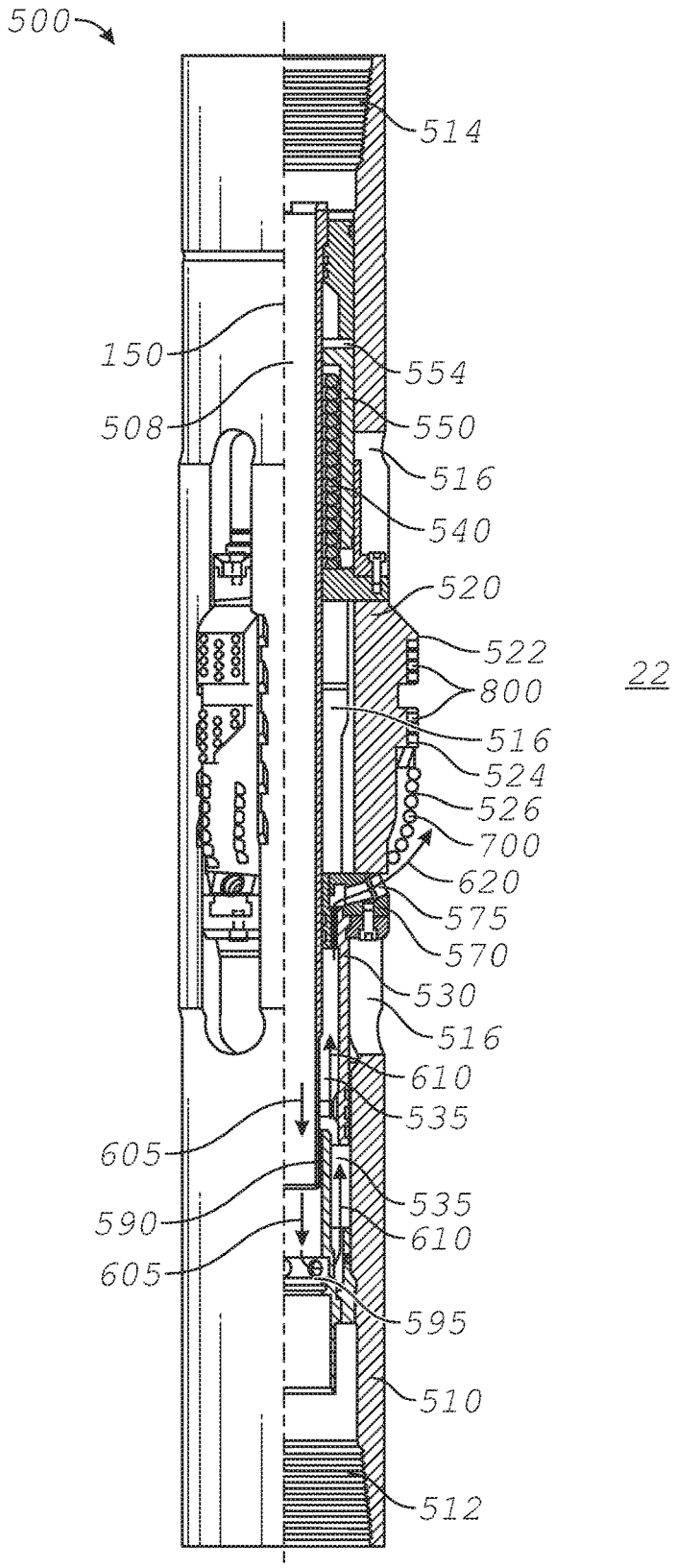

Referring to FIGS. 1B and 1C, an expandable tool, which may be used in embodiments of the present disclosure, generally designated as 500, is shown in a collapsed position in FIG. 1B and in an expanded position in FIG. 1C. The expandable tool 500 may include a generally cylindrical tubular tool body 510 with a flowbore 508 extending therethrough and a longitudinal axis 150 defined therethrough. As shown, the tool body 510 may include an upper connection portion 514 and a lower connection portion 512 for coupling the expandable tool 500 to a drill string, BHA, or other drilling assembly. Further, as shown, one or more pocket recesses 516 may be formed in the tool body 510, and optionally at approximately the axial center of the tool body 510. The one or more pocket recesses 516 may be spaced apart azimuthally around the circumference of the tool body 510. The one or more pocket recesses 516 may accommodate the axial movement of several components of the expandable tool 500 that move axially up or down within the pocket recesses 516, including one or more moveable tool arms, such as cutter blocks 520. The cutter blocks 520 520 may be non-pivotable in some embodiments, but movable tool arms may pivot in other embodiments. Each pocket recess 516 may store one cutter block 520 in the collapsed position.

FIG. 1C shows the expandable tool 500 with the cutter blocks 520 in an expanded position (e.g., a maximum expanded position), extending radially outwardly from the tool body 510. Once the expandable tool 500 is in the well bore, one or more of the cutter blocks 520 may be expandable to one or more radial positions. The expandable tool 500 may therefore have at least two operational positions—including at least a collapsed position as shown in FIG. 1B and an expanded position as shown in FIG. 1C. In other embodiments, the expandable tool 500 may have multiple operational positions where the cutter blocks 520 are between fully retracted and fully expanded states. In some embodiments, a spring retainer 550, which may include a threaded sleeve, may be adjusted at the surface or using a downhole drive system, to limit the full diameter expansion of the cutter blocks 520. The spring retainer 550 may compress a biasing spring 540 when the expandable tool 500 is collapsed, and the position of the spring retainer 550 may determine the amount of expansion of the cutter blocks 520. The spring retainer 550 may be adjusted by a wrench (not shown) in a wrench slot 554 that may rotate the spring retainer 550 axially downwardly or upwardly with respect to the tool body 510 at the threads 551.

In the expanded position shown in FIG. 1C, the cutter blocks 520 may perform one or more of underreaming the well bore, backreaming the well bore, or stabilizing the drilling assembly within the well bore. The operations performed may depend on the configuration of the cutter blocks 520, including one or more pads 522, 524 and a surface 526, as will be further discussed in relation to cutting structures of embodiments disclosed herein. Hydraulic force may cause the cutter blocks 520 to expand radially outwardly (and optionally to move axially upwardly) to the position shown in FIG. 1C due to the differential pressure of the drilling fluid between the flowbore 508 and the well bore annulus 22.

In one or more embodiments, optional depth of cut limiters 800 on pads 522 and 524 may be formed from polycrystalline diamond, tungsten carbide, titanium carbide, cubic boron nitride, other superhard materials, or some combination of the foregoing. Depth of cut limiters 800 may include inserts with cutting capacity, such as back up cutters, diamond impregnated inserts with less exposure than primary cutting elements, diamond enhanced inserts, tungsten carbide inserts, semi-round top inserts, or other inserts that may or may not have a designated cutting capacity. Optionally, the depth of cut limiters 800 may not primarily engage formation during reaming; however, after wear of primary cutting elements, depth of cut limiters 800 may engage the formation to protect the primary cutting elements from increased loads as a result of worn primary cutting elements. In one or more embodiments, depth of cut limiters 800 may be positioned behind, i.e., above or uphole from, primary cutting elements at a selected distance, such that depth of cut limiters may remain unengaged with formation until wear of other cutting elements occurs. Depth of cut limiters 800, as described herein, may aid in maintaining a desired well bore gauge by providing increased structural integrity to the cutter block 520.

Drilling fluid may flow along path 605, through ports 595 in a lower retainer 590, along path 610 into the piston chamber 535. The differential pressure between the fluid in the flowbore 508 and the fluid in the well bore annulus 22 surrounding expandable tool 500 may cause the piston 530 to move axially upwardly from the position shown in FIG. 1B to the position shown in FIG. 1C. A small amount of flow can move through the piston chamber 535 and through nozzles 575 to the well bore annulus 22 as the cutter blocks 520 of the expandable tool 500 start to expand. As the piston 530 moves axially upwardly in pocket recesses 516, the piston 530 engages the drive ring 570, thereby causing the drive ring 570 to move axially upwardly against the cutter blocks 520. The cutter blocks 520 will move axially upwardly in pocket recesses 516 and also radially outwardly as the cutter blocks 520 travel in channels 518 in or on the tool body 510. In the expanded position, the flow continues along paths 605, 610 and out into the well bore annulus 22 through nozzles 575. The nozzles 575 may be part of the drive ring 570, and may therefore move axially with the cutter blocks 520. Accordingly, these nozzles 575 are optimally positioned to continuously provide cleaning and cooling to the cutting elements 700 on surface 526 as fluid exits to the well bore annulus 22 along flow path 620.

The expandable tool 500 may be designed to remain generally concentric with the well bore. In particular, expandable tool 500, in one embodiment, may include three extendable cutter blocks 520 spaced apart circumferentially at the same axial location on the tool body 510. In some embodiments, the circumferential spacing may be approximately 120°. This three-arm design may provide a full gauge expandable tool 500 that remains centralized in the well bore. Those having ordinary skill in the art will appreciate that embodiments disclosed herein are not limited to tool embodiments having three extendable cutter blocks 520. For example, in one or more embodiments, the expandable tool 500 may include different configurations of circumferentially spaced cutter blocks or other types of arms, for example, one arm, two arms, four-arms, five-arms, or more than five-arm designs. Thus, in specific embodiments, the circumferential spacing of the arms may vary from the 120° spacing illustrated herein. For example, in alternate embodiments, the circumferential spacing may be 90°, 60°, or the cutter blocks 520 may be circumferentially spaced in non-equal increments. Further, in some embodiments, one or more of the cutter blocks 520 may be axially offset from one or more other cutter blocks 520. Accordingly, the cutting structure designs disclosed herein may be used with any number of cutting structures and tools.

Figure 2A:
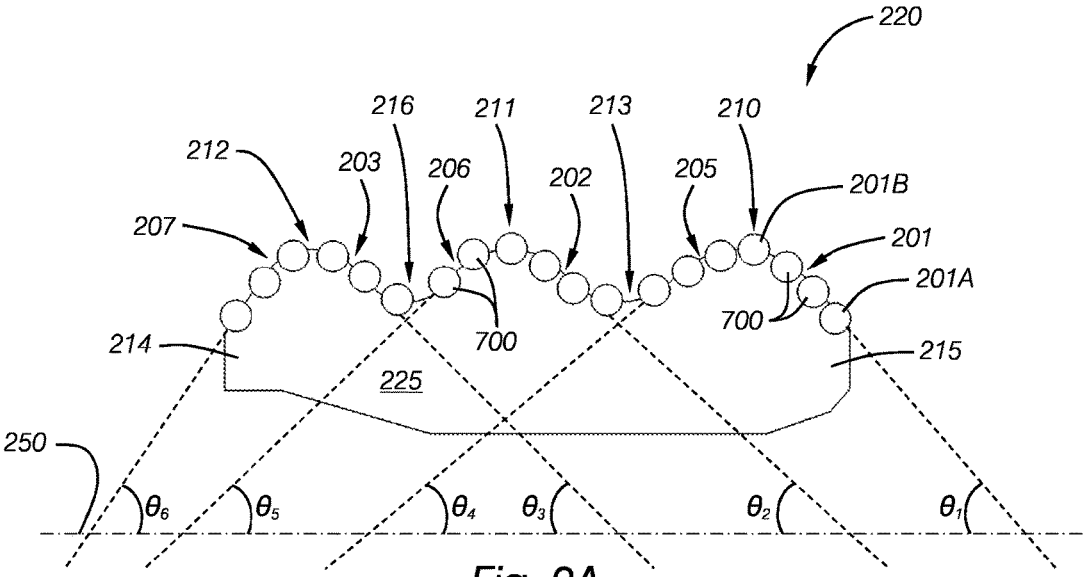
FIG. 2A is a side view of a cutter block, in accordance with embodiments disclosed herein.

Referring now to FIG. 2A, a side view of a cutter block 220 is shown. As shown, the cutter block 220 includes a body 225 having a downhole end portion 215 and an uphole end portion 214. In one or more embodiments, the body 225 may be formed of a metal, cermet, ceramic, other material, or some combination thereof. For instance, the body 225 may be formed of steel or from a matrix material which may include a ceramic such as tungsten carbide or any other material known in the art. The cutter block 220 may be configured to be coupled to a downhole tool (e.g., the expandable tool 500 of FIGS. 1B and 1C), the downhole tool having a longitudinal axis 250 defined therethrough. Those having ordinary skill in the art will also appreciate that the longitudinal axis 250 may be considered to be a longitudinal axis of the cutter block 220, a well bore, or some other component.

In one or more embodiments, the downhole end portion 215 of the cutter block 220 may be further downhole than the uphole end portion 214 of the cutter block 220 when the cutter block 220 is coupled to the downhole tool and positioned downhole. In one or more embodiments, the cutter block 220 may have a row 226 of cutting elements 700 thereon or therein. The cutting elements 700 may be coupled to a surface of the cutter block 220, and the surface may define a profile of the cutter block 220. In one or more embodiments, the cutting elements 700 may be formed from polycrystalline diamond. The cutting elements 700 may be formed from tungsten carbide, titanium carbide, natural diamond, cubic boron nitride, or any other material known in the art.

Further, as shown, the cutter block 220 may include a first underreaming cutting edge 201, a second underreaming cutting edge 202, and a third underreaming cutting edge 203. As used herein, "cutting edge" refers to a portion of the cutter block including cutting elements located at incremental increasing radial distances from the longitudinal axis 250. For example, the first underreaming cutting edge 201, when used, may include a first cutting element 201A and a last cutting element 201B, where the last cutting element 201B is, in the illustrated embodiment, at or near the outermost or gauge diameter (or radial position) of the cutter block 240. The cutting elements between the first cutting element 201A and the last cutting element 201B may make progressively deeper cuts into the formation. In other embodiments, the first cutting element 201A could be at or near the outermost diameter of the cutting block 240, and the last cutting element 201B could be near the innermost diameter of the cutting block 240.

One or more of the first underreaming cutting edge 201, the second underreaming cutting edge 202, or the third underreaming cutting edge 203 may be used to cut a portion of a well bore during an underreaming operation (e.g., by expanding an existing well bore diameter). In one or more embodiments, the cutter block 220 may also include a first backreaming cutting edge 205, a second backreaming cutting edge 206, or a third backreaming cutting edge 207. One or more of the first backreaming cutting edge 205, the second backreaming cutting edge 206, or the third backreaming cutting edge 207 may be used to cut a portion of a well bore during a backreaming operation. Cutting edges 202-207 may include cutting elements similar to those described herein for the first underreaming cutting edge 201.

In some embodiments, a cutting element (e.g., cutting element 201B) may be on both an underreaming cutting edge and a backreaming cutting edge. Those having ordinary skill in the art will appreciate that both an underreaming operation and a backreaming operation may be considered a drilling operation.

As shown, the first backreaming cutting edge 205 may be positioned axially between the first underreaming cutting edge 201 and the second underreaming cutting edge 202, and the second backreaming cutting edge 206 may be positioned axially between the second underreaming cutting edge 202 and the third underreaming cutting edge 203. Further, as shown, the third backreaming cutting edge 207 may be positioned above the second backreaming cutting edge 206. In other words, the third backreaming cutting edge 207 may be uphole from the second backreaming cutting edge 206 when the cutter block 220 is coupled to a drilling assembly and positioned downhole.

In one or more embodiments, the cutter block 220 may have a non-uniform or non-symmetric profile. For example, as shown in FIG. 2A, the surface to which the cutting elements 700 are coupled may define a profile of the cutter block 220, and the surface to which the cutting elements 700 are coupled may not have a constant radial distance relative to the longitudinal axis 250 along a length of the cutter block 220. Instead, in one or more embodiments, the profile of the cutter block 220 may be defined by at least two peaks and at least one valley, or at least two valleys and at least one peak. While multiple peaks may be the same width and/or height, and multiple valleys may be the same depth and/or width, in other embodiments peaks and valleys on a cutter block may have different dimensions or configurations relative to each other.

As shown in FIG. 2A, the cutter block 220 may include a first peak 210, a second peak 211, and a third peak 212. Further, as shown, the cutter block 220 includes a first valley 213 and a second valley 216. Two or more peaks and at least one valley formed on the cutter block 220 may provide a non-uniform radial profile of the cutter block 220.

As noted above, in one or more embodiments, a height of each of the at least two peaks of the cutter block 220 (e.g., relative to the longitudinal axis 250) may be substantially equal. For example, in one or more embodiments, the height of each of the first peak 210, the second peak 211, and the third peak 212 of the cutter block 220 may be substantially equal to each other. As such, the first peak 210, the second peak 211, and the third peak 212 of the cutter block 220 may provide three separate points of contact, e.g., with a well bore wall, which may increase stabilization of the cutter block 220 against downhole surfaces.

In one or more embodiments, one or more portions of the various cutting edges of the cutter block 220 may contact and drill into the formation. As such, in one or more embodiments, the peaks of the cutter block 220 described herein may act as pivot points or fulcrums for the cutter block 220 as a whole, and may also aid in stabilizing the cutter block 220 downhole. As such, according to embodiments disclosed herein, the cutter block 220 may include two, three, four, or more peaks, which may provide increased stabilization of the cutter block 220 downhole.

Further, because the height of each of the first peak 210, the second peak 211, and the third peak 212 of the cutter block 220 may be substantially equal to each other, a constant gauge of cut may be maintained if one or more of the underreaming cutting edges or one or more of the backreaming cutting edges fails. In other words, the effective gauges of each of the first underreaming cutting edge 201, the second underreaming cutting edge 202, and the third underreaming cutting edge 203 may be substantially equivalent. Similarly, in some embodiments, the effective gauge of each of the first backreaming cutting edge 205, the second backreaming cutting edge 206, and the third backreaming cutting edge 207 may be substantially equivalent.

For example, during a drilling operation, the first underreaming cutting edge 201 may be used to drill a portion of a well bore (e.g., by moving the cutter block 220 in a downhole direction). If the first underreaming cutting edge 201 fails and is worn or destroyed, i.e., the first underreaming cutting edge 201 may experience washout. The effective gauge of the well bore may nevertheless be maintained because the second underreaming cutting edge 202 may then contact and drill a portion of the well bore in place of the first underreaming cutting edge 201.

Figure 2B:
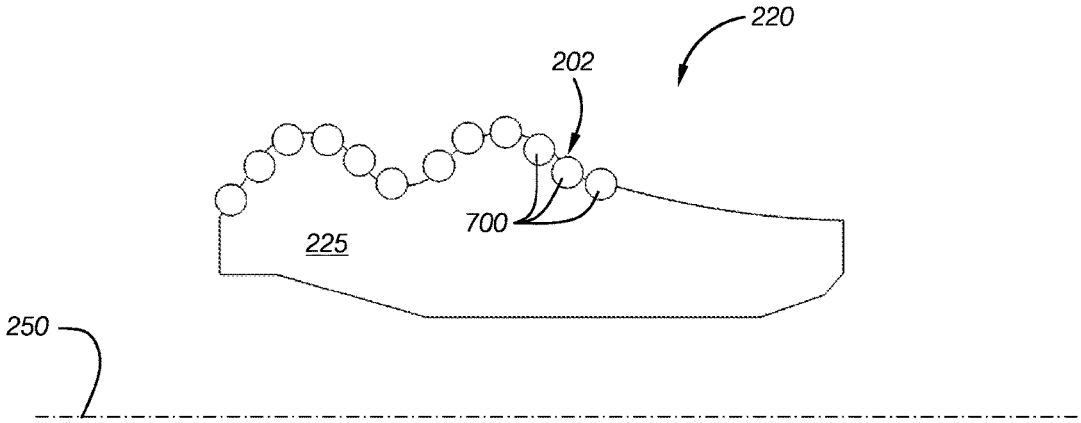
FIG. 2B is a side view of the cutter block of FIG. 2A after experiencing washout, in accordance with embodiments disclosed herein.

Referring to FIG. 2B, a side view of the cutter block 220 shown in FIG. 2A after experiencing washout is shown. Although the first underreaming cutting edge (not shown) is washed out, the second underreaming cutting edge 202 may be able to contact and drill a portion of the well bore with cutting elements 700 in place of the first underreaming cutting edge. As discussed herein, the effective gauge of the first underreaming cutting edge 201 and the second underreaming cutting edges 202 may be substantially equivalent because the height of the first peak 210 (before washout) may be substantially equal to the height of the second peak 211.

Although it may be desired for the height of each of the first peak 210, the second peak 211, and the third peak 212 to be equal to each other, equal heights within very small tolerances may be difficult to actually achieve in practice. As such, minor variations between the height of each of the first peak 210, the second peak 211, and the third peak 212 should be within the meaning of the phrases "substantially equal" or "substantially equivalent" as used herein.

In one or more embodiments, a depth of cut limiter may be positioned on one or more (and potentially each) of the at least two peaks. As such, each of the at least two peaks may be used as a gauge pad or stabilizer pad to maintain well bore gauge and/or to stabilize the downhole cutting apparatus. As discussed herein, depth of cut limiters may include inserts or other elements with or without cutting capacity, and may include back up cutters, diamond impregnated inserts with less exposure than primary cutting elements, diamond enhanced inserts, tungsten carbide inserts, other inserts, or some combination of the foregoing. In one or more embodiments, depth of cut limiters may be axially or rotationally behind other cutting elements. For instance, depth of cut limiters may be axially above or uphole from other cutting elements at a selected distance, such that depth of cut limiters may remain unengaged with formation until wear of primary cutting elements occurs. In other embodiments, depth of cut limiters may be rotationally behind primary cutting elements, and may therefore also be considered to be trailing elements. Trailing depth of cut limiters may be positioned rotationally directly behind a primary cutting element, or between two cutting elements.

Figure 2C:
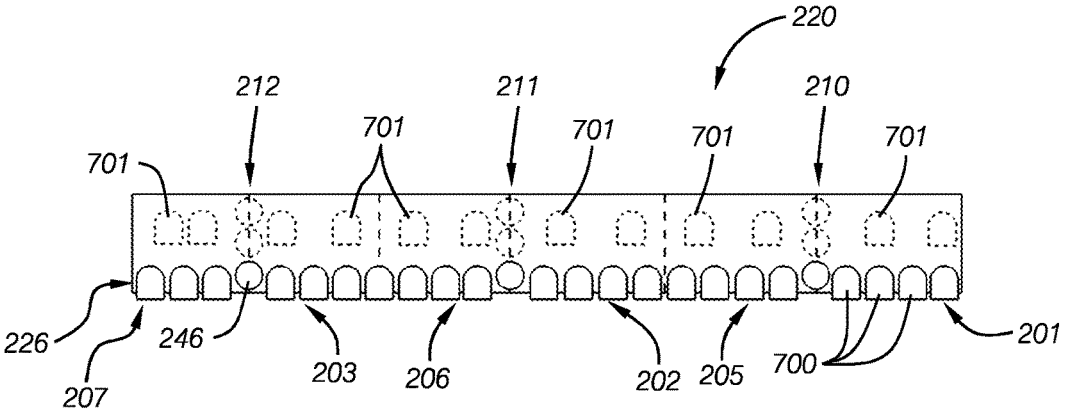
FIG. 2C is a top view of a cutter block similar to the cutter block of FIG. 2A, in accordance with embodiments disclosed herein.

In one or more embodiments, and as shown in FIG. 2C, depth of cut limiters 246 may be positioned on each of the first peak 210, the second peak 211, and the third peak 212. Such a depth of cut limiter 246 may aid in maintaining a desired well bore gauge by providing increased structural integrity to the cutter block 220. Depth of cut limiters 246 on one or more of the first peak 210, the second peak 211, or the third peak 212 may be uphole from the first underreaming cutting edge 201, the second underreaming cutting edge 202, and the third underreaming cutting edge 203, respectively.

Those having ordinary skill in the art will appreciate, however, that one or more of the first backreaming cutting edge 205, the second backreaming cutting edge 206, or the third backreaming cutting edge 207 may also be cutting edges and may have cutting elements thereon, therein, or otherwise coupled thereto. As such, in one or more embodiments, depth of cut limiters 246 on one or more of the first peak 210, the second peak 211, or the third peak 212 may be downhole from the first backreaming cutting edge 205, the second backreaming cutting edge 206, or the third backreaming cutting edge 207.

The depth of cut may be limited by the depth of cut limiters 246 on the peaks 210, 211, 212, however, depth of cut may be limited in other manners, or the depth of cut limiters 246 may be omitted. In some embodiments, the depth of cut limiters 246 may act as gauge protection elements. Further, while the depth of cut limiters 246 may generally be aligned with a row 226 of cutting elements 700 as shown in FIG. 2C, depth of cut limiters 246 may instead be offset from the cutting elements 700 as shown by the positions of depth of cut limiters 246 shown in phantom lines. Multiple depth of cut limiters 246 may also be included on a peak.

Further, in some embodiments, one or more back-up cutting elements 701 may be coupled to the cutter block 220. In particular, as shown in FIG. 2C, a first row 226 of cutting elements 700 may be positioned in cutter element pockets formed on or near a leading edge of the cutter block 220. Optionally, the one or more back-up cutting elements 701 (shown in phantom lines), may be positioned in cutter element pockets or otherwise coupled to the cutter block 220 and behind the first row 226 of cutting elements 700. The back-up cutting elements 701 may be considered to be rotationally behind the cutting elements 700 as the cutter block 220 may be configured to rotate and the cutting elements 700 may be on a leading edge during such rotation. In some embodiments, one or more of the back-up cutting elements 701 may be positioned directly behind a cutting element 700 of the first row 226 (see cutting edges 201, 203, 206). One or more of the back-up cutting elements 701 may in the same or other embodiments, be positioned behind, but between, two cutting elements 700 of the first row 226 (see cutting edges 202, 205, 207). Where back-up cutting elements 701 are included, each back-up cutting element 701 may be directly behind a leading cutting element 700, each back-up cutting element 701 may be offset from a leading cutting element 700 (e.g., between two cutting elements 700), or a combination of placements may be used. Although the cutting elements 700 and back-up cutting elements 701 are shown as shear cutters having a circular, planar, in other embodiments, the cutting elements 700 and/or the back-up cutting elements 701 may have different configurations. For instance, the cutting elements 700 and/or back-up cutting elements 701 may have an engaging surface that is conical, frusto-conical, semi-round, ridged, or otherwise contoured. Further, cutting elements 700 and/or back-up cutting elements 701 may be oriented at different orientations (e.g., to shear or gouge), at different rake angles, and the like.

In one or more embodiments, underreaming cutting edges and backreaming cutting edges may be oriented at any of various angles relative to the longitudinal axis 250. In some embodiments, an angle formed between one underreaming cutting edge and the longitudinal axis 250 may be less than an angle formed between another underreaming cutting edge and the longitudinal axis of the tubular body, although in other embodiments such angles may be equal. For example, referring to FIG. 2A, a first angle $\theta_1$ may be formed between the first underreaming cutting edge 201 and the longitudinal axis 250, and a second angle $\theta_2$ may be formed between the second underreaming cutting edge 202 and the longitudinal axis 250. First angle $\theta_1$ may be equal to second angle $\theta_2$, although first angle $\theta_1$ and second angle $\theta_2$ may be different. For instance, first angle $\theta_1$ may be less than second angle $\theta_2$. In such an embodiment, an initial attacking angle for underreaming with the first underreaming cutting edge 201 may be less steep than a secondary attacking angle for underreaming with the second underreaming cutting edge 202. Such a configuration may provide a higher effective cutting element density for the first underreaming cutting edge 201 during an underreaming operation. In one or more embodiments, the first angle $\theta_1$ may be equal to, or greater than, the second angle $\theta_2$.

Similarly, in one or more embodiments, the second angle $\theta_2$ formed between the second underreaming cutting edge 202 and the longitudinal axis 250 of the tubular body of the downhole tool may be less than a third angle $\theta_3$ formed between the third underreaming cutting edge 203 and the longitudinal axis 250. Those having ordinary skill in the art will appreciate, however, that in one or more embodiments, the second angle $\theta_2$ may be equal to or greater than the third angle $\theta_3$.

Further, in one or more embodiments, angles may be defined between backreaming cutting edges and the longitudinal axis 250. For instance, a fourth angle $\theta_4$ may be formed between the first backreaming cutting edge 205 and the longitudinal axis 250, and a fifth angle $\theta_5$ may be formed between the second backreaming edge 206 and the longitudinal axis 250, and a sixth angle $\theta_6$ may be formed between the third backreaming edge 207 and the longitudinal axis 250. The angles $\theta_4$, $\theta_5$, $\theta_6$ may be equal or different. For instance, the fourth angle $\theta_4$ may be greater than the fifth angle $\theta_5$. Furthermore, in one or more embodiments, the fifth angle $\theta_5$ may be greater than the sixth angle $\theta_6$. In such an embodiment, an initial attacking angle for backreaming with the third backreaming cutting edge 207 may be less steep than a secondary attacking angle for backreaming with the second backreaming cutting edge 206. Similarly, in one or more embodiments, the attacking angle for backreaming with the second backreaming cutting edge 206 may be less than an attacking angle for backreaming with the first backreaming cutting edge 205. Such a configuration may provide a higher effective cutting element density for the third backreaming cutting edge 207 during a backreaming operation. Those having ordinary skill in the art will appreciate, however, that in one or more embodiments, the fourth angle $\theta_4$ may be less than or equal to the fifth angle $\theta_5$, the fifth angle $\theta_5$ may be less than or equal to the sixth angle $\theta_6$, and the fourth angle $\theta_4$ may be less than, greater than, or equal to the sixth angle $\theta_6$.

In one or more embodiments, angles $\theta_1$, $\theta_2$, $\theta_3$, $\theta_4$, $\theta_5$, and $\theta_6$ may be substantially equivalent angles. Further, in one or more embodiments, angles $\theta_1$, $\theta_2$, $\theta_3$, $\theta_4$, $\theta_5$, and $\theta_6$ may each be non-right angles relative to the longitudinal axis 250. In other words, in one or more embodiments, angles formed between each underreaming cutting edge and the longitudinal axis 250 and/or each backreaming cutting edge and the longitudinal axis 250 of the tubular body of the downhole tool may be less than 90°. For instance, one or more of the angles $\theta_1$, $\theta_2$, $\theta_3$, $\theta_4$, $\theta_5$, and $\theta_6$ may be within a range having lower and/or upper limits including any of 10°, 20°, 30°, 40°, 50°, 60°, 70°, 80°, 89°, or values therebetween. For instance, any of the angles $\theta_1$, $\theta_2$, $\theta_3$, $\theta_4$, $\theta_5$, and $\theta_6$ may be between 20° and 70°, between 30° and 60°, or between 35° and 55°. In still other embodiments, one or more of the angles $\theta_1$, $\theta_2$, $\theta_3$, $\theta_4$, $\theta_5$, and $\theta_6$ may be less than 10° or greater than 89° (e.g., right or obtuse angles).

During a drilling operation, the first underreaming cutting edge 201 may be used to drill and expand a diameter of a portion of a well bore. If the first underreaming cutting edge 201 fails and is worn or destroyed, e.g., as discussed above in reference to FIG. 2B, the second underreaming cutting edge 202 may then contact and ream a portion of the well bore in place of the first underreaming cutting edge 201. Similarly, if the second underreaming cutting edge 202 fails and is worn or destroyed, the third underreaming cutting edge 203 may then contact and ream a portion of the well bore in place of the second underreaming cutting edge 202.

Further, during a drilling operation the third backreaming cutting edge 207 may be used to ream a portion of a well bore. If the third backreaming cutting edge 207 fails and is worn or destroyed, the second backreaming cutting edge 206 may then contact and ream a portion of the well bore in place of the third backreaming cutting edge 207. Similarly, if the second backreaming cutting edge 206 fails and is worn or destroyed, the first backreaming cutting edge 205 may then contact and ream a portion of the well bore in place of the second backreaming cutting edge 206.

A cutter block 220, as described herein, may allow a drilling operation, e.g., which may include an underreaming operation and/or a backreaming operation, to continue even if an underreaming cutting edge or backreaming cutting edge fails, washes out, or is worn and partially destroyed. The downhole tool may therefore not be removed from the well bore to replace the cutter block 220. Further, the cutter block 220 may allow the drilling operation to continue if an underreaming cutting edge or backreaming cutting edge fails and is worn and destroyed without having to rely on deployment, e.g., mechanical deployment, of a replacement cutting edge from one or more downhole tools. In some embodiments, the cutter block 220 may be monolithic.

In one or more embodiments, a cutter block may include at least one stabilizer pad in addition to one or more underreaming or backreaming cutting edges. For instance, a stabilizer pad may be uphole of, downhole of, or between one or more underreaming cutting edges, one or more backreaming cutting edges, or an underreaming cutting edge and a backreaming cutting edge. For instance, a stabilizer pad may extend fully or partially between a first underreaming cutting edge and a first backreaming cutting edge. Optionally, at least one depth of cut limiter may be on, in, or otherwise coupled to the at least one stabilizer pad.

Figure 3A:
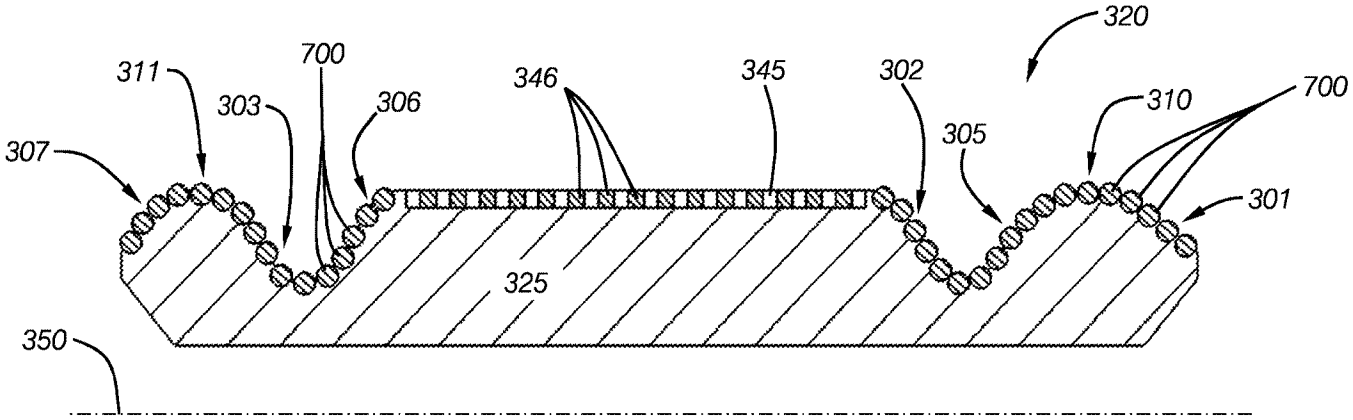
FIG. 3A is a cross-sectional view of a cutter block, in accordance with embodiments disclosed herein.

For example, referring to FIG. 3A, a side view of a cutter block 320 is shown. As shown, the cutter block 320 may include a body 325. In one or more embodiments, the body 325 may be formed from metal, matrix material, or other material. For instance, the body 325 may include steel, tungsten carbide, or any other material known in the art. As shown, the cutter block 320 includes a first underreaming cutting edge 301, a second underreaming cutting edge 302, a third underreaming cutting edge 303, a first backreaming cutting edge 305, a second backreaming cutting edge 306, and a third backreaming cutting edge 307. One or more cutting elements 700 may be positioned on the cutting edges 301, 302, 303, 305, 306, 307.

Further, the cutter block 320 may, in some embodiments, include a stabilizer pad 345. In one or more embodiments, the stabilizer pad 345 may be or include a portion of the cutter block 320 configured to stabilize the cutter block 320 while downhole. In some embodiments, one or more depth of cut limiters 346 may be on or within the stabilizer pad 345.

The depth of cut limiters 346 may include inserts configured to cut, shear, or otherwise degrade formation or other materials, or to act as gauge protection elements to maintain the gauge diameter of the downhole tool. Example depth of cut limiters 246 may include back-up cutters, diamond impregnated inserts (potentially with less exposure than primary cutting elements), diamond enhanced inserts, tungsten carbide inserts, other inserts that do not have a designated cutting capacity, or some combination of the foregoing. In some embodiments, the depth of cut limiters 346 may not initially engage a well bore formation during drilling, but after wear of primary cutting elements 700 the depth of cut limiters 346 may engage the formation to protect the cutting elements 700 from increased loads. In other embodiments, the depth of cut limiters 346 may engage the formation before or with the cutting elements 700. The depth of cut limiters 346, as described herein, may aid in maintaining a desired well bore gauge by providing increased structural integrity to the cutter block 320.

In one or more embodiments, a height of the at least one stabilizer pad 345 having at least one depth of cut limiter 346 thereon may be substantially equal to a height of at least two peaks 310, 311 of the cutter block 320. As shown in FIG. 3A, the peaks 310, 311 may have substantially equal heights, and the stabilizer pad 345 may also have a substantially equal height. In other words, an apex of each of the two peaks 310 and 311 may each be at a distance from a longitudinal axis 350 that is substantially equal to a distance between an outer surface of the stabilizer pad 345 and the longitudinal axis 350. In other embodiments, one or more of the peaks 310, 311 or the stabilizer pad 345 may have a different height.

In one or more embodiments, the stabilizer pad 345 may have components other than (or in addition to) depth of cut limiters 346 coupled thereto. For example, in one or more embodiments, the stabilizer pad 345 may include cutting elements (e.g., cutting elements 700), and a portion of the stabilizer pad 345 may be configured to achieve underreaming and/or backreaming, similar to that of the underreaming cutting edges 301, 302, 303 and the backreaming cutting edges, 305, 306, 307, respectively.

Figure 3B:
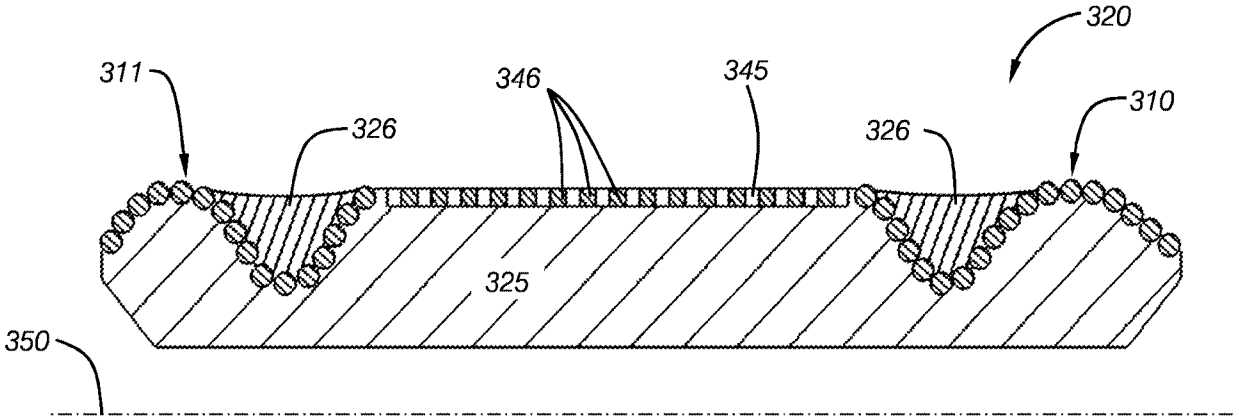
FIG. 3B is a cross-sectional view of a cutter block, in accordance with embodiments disclosed herein.

As shown in FIG. 3B, in one or more embodiments, one or more fillings 326 may be positioned between an underreaming cutting edge (e.g., the second underreaming cutting edge 302), and a backreaming cutting edge (e.g., the first backreaming cutting edge 305). The one or more fillings 326 may, in some embodiments, protect one or more underreaming/backreaming cutting edges from wear. Further, such fillings 326 may minimize gauge diameter loss, or other material loss. In one or more embodiments, the fillings 326 may be metal or matrix material fillings, which may be formed from substantially the same material as the body 325 of the cutter block 320 such as steel, tungsten carbide, or any other material known in the art. In one or more embodiments, the fillings 326 may include diamond chips and/or other materials to limit wear of the fillings 326.

In one or more embodiments, the cutter block may include more than one row of cutting elements. For example, in one or more embodiments, the cutter block may include two or more rows of cutting elements, in which one or more rows of cutting elements include a first underreaming cutting edge, a second underreaming cutting edge, and a first backreaming cutting edge between the first underreaming cutting edge and the second underreaming cutting edge, as discussed above. In one or more embodiments, a first backreaming cutting edge of a first row of cutting elements may be circumferentially offset (i.e., rotationally or laterally offset) from a first underreaming cutting edge of a second row of cutting elements. In one or more other or additional embodiments, the first backreaming cutting edge of the first row of cutting elements may axially overlap along a longitudinal axis of a tubular body of a downhole tool with the first underreaming cutting edge of the second row of cutting elements.

Figure 4:
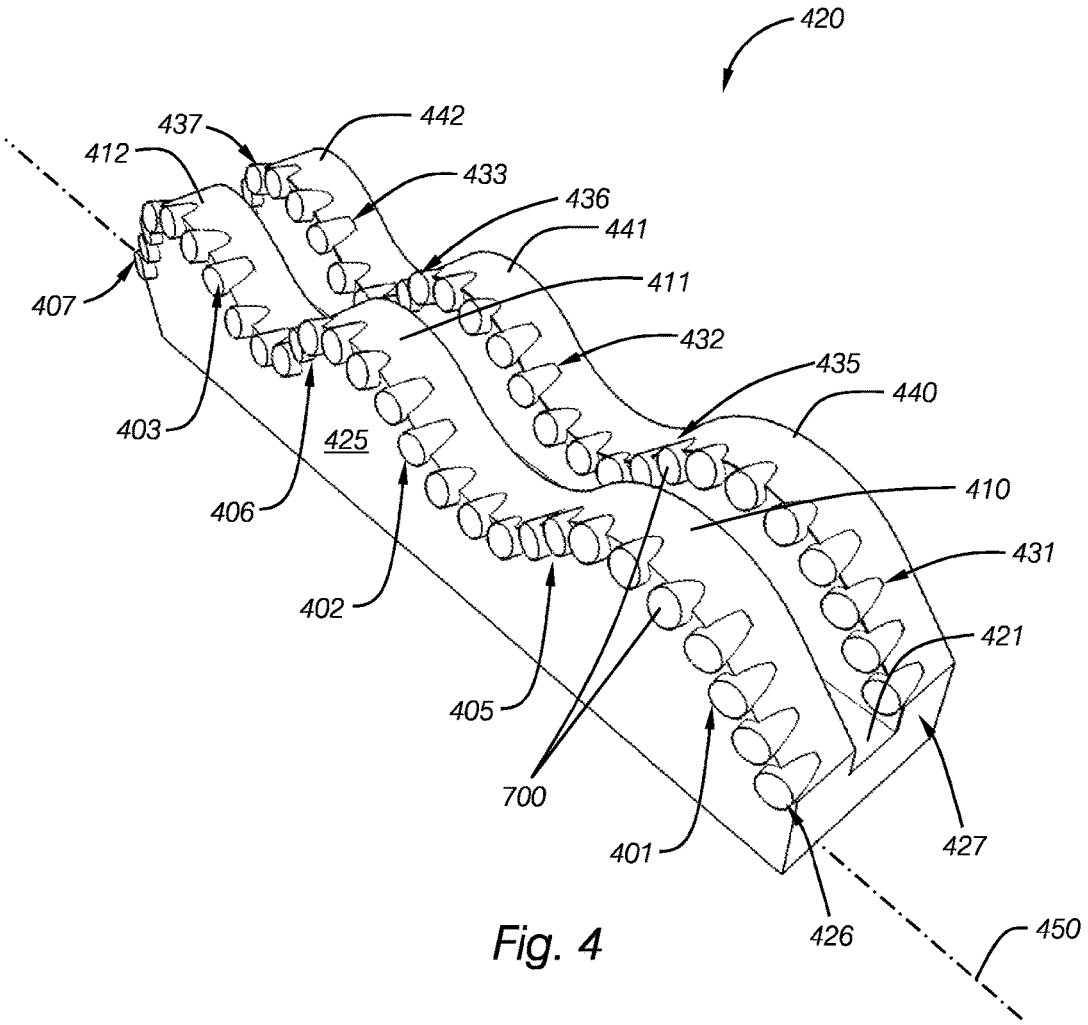
FIG. 4 is a perspective view of a cutter block, in accordance with embodiments disclosed herein.

For example, referring to FIG. 4, a perspective view of a cutter block 420 is shown. As shown, the cutter block 420 includes a body 425, a first row 426 of cutting elements 700, and a second row 427 of cutting elements 700, in which the first row 426 of cutting elements 700 is rotationally or laterally offset from the second row 427 of cutting elements. In particular, the first row 426 and second row 427 may extend axially along the length of the cutter block 420 such that cutting elements 700 of the first and second rows 426, 427 may have overlapping axial positions; however, the cutting elements 700 of the separate rows 426, 427 may not be in engagement or contact by virtue of the rotational or lateral offset between the rows 426, 427.

In some embodiments, channel 421 may be provided intermediate the first row 426 and the second row 427. The channel 421 may be a flow channel to provide for drilling fluid flow. In the same or other embodiments, the channel 421 may allow for the evacuation of cuttings or other debris, as well as allowing fluid to lubricate and cool the cutting elements 700. The channel 421 may be a recess formed in the cutter block 420, and may continue along a full or partial axial length of the cutter block 420. In some embodiments, multiple channels may be included, including channels that are axially or laterally offset.

As shown, the first row 426 of cutting elements 700 may include multiple underreaming and/or backreaming edges. For instance, the first row 426 of cutting elements 700 may be formed along a surface of the body 425 that defines a first underreaming cutting edge 401, a second underreaming cutting edge 402, a third underreaming cutting edge 403, a first backreaming cutting edge 405, a second backreaming cutting edge 406, and a third backreaming cutting edge 407. In other embodiments, more or fewer backreaming or underreaming cutting edges may be included. In the illustrated embodiment, the first row 426 of cutting elements 700 includes a first peak 410, a second peak 411, a third peak 412, and two valleys. Further, as shown, the second row 427 of cutting elements 700 may include multiple underreaming and backreaming edges which can be the same as, or different from, those of the first row 426 of cutting elements 700. The illustrated embodiment depicts the surface of the body 425 and the second row 427 of cutting elements 700 as defining a first underreaming cutting edge 431, a second underreaming cutting edge 432, a third underreaming cutting edge 433, a first backreaming cutting edge 435, a second backreaming cutting edge 436, and a third backreaming cutting edge 437. As such, the second row 427 of cutting elements 700 includes a first peak 440, a second peak 441, a third peak 442, and two valleys.

In one or more embodiments, the cutting elements 700 of the first row 426 and the second row 427 may be substantially identical. In one or more other embodiments, however, the cutting elements 700 of the first row 426 and the second row 427 may be different types of cutting elements. For example, the cutting elements of the first row 426 may be formed from a first material and may be a formed in one or more first shapes and sizes. The cutting elements of the second row 427 may be formed from a second material and/or may be formed in one or more second shapes and/or sizes, which may be the same or different than those of the first row 426.

In some embodiments, a height of the each of the first peak 410, the second peak 411, and the third peak 412 of the first row 426 may be substantially equal to each other. Optionally, a height of each of the first peak 440, the second peak 441, and the third peak 442 of the second row 427 may be substantially equal to each other. Furthermore, in one or more embodiments, the heights of each of the first peak 410, the second peak 411, and the third peak 412 of the first row 426 and the first peak 440, the second peak 441, and the third peak 442 of the second row 427 may be substantially equal to each other. As such, a constant gauge of cut may be maintained if one or more of the underreaming cutting edges or one or more of the backreaming cutting edges fails, as discussed herein. Further, as discussed herein, a depth of cut limiter may be coupled to the body 425 (e.g., on one or more of the peaks 410, 411, 412, 440, 441, 442 of the first row 426 and/or the second row 427 of cutting elements 700. In other embodiments, the peaks of the first row 426 and/or the second row 427 may have different heights, or peaks of a same row may have differing heights.

For instance, although the heights of each of the peaks 410, 411, 412 of the first row 426 may be substantially equivalent, and the peaks 440, 441, 442 of the second row 427 may be substantially equivalent, the heights of the peaks of the first row 426 and the heights of the peaks of the second row 427 may not be substantially equal to each other in other embodiments. For example, in one or more embodiments, a height of the first peak 440, the second peak 441, and the third peak 442 of the second row 427 may be higher, i.e., a greater distance from the longitudinal axis 450, than a height of the first peak 410, the second peak 411, and the third peak 412 of the first row 426. Such a configuration may allow the cutting elements 700 of the first row 426 to dig out a portion of a well bore formation and allow the cutting elements 700 of the second row 427 to further extend the diameter of the well bore by drilling an additional portion of the well bore formation.

In one or more embodiments, the first row 426 of cutting elements 700 may be rotationally or laterally offset from the second row 427 of cutting elements 700. As such, the first underreaming cutting edge 401 of the first row 426 may be rotationally or laterally offset from the first underreaming cutting edge 431 of the second row 427. In one or more embodiments, the first underreaming cutting edge 401 of the first row 426 may be at least partially axially aligned with the first underreaming cutting edge 431 of the second row 427. Similarly, the second underreaming cutting edge 402 of the first row 426 may fully or partially axially overlap the second underreaming cutting edge 432 of the second row 427, and the third underreaming cutting edge 403 of the first row 426 may fully or partially axially overlap the third underreaming cutting edge 433 of the second row 427. Further, as shown in FIG. 4, the first backreaming cutting edge 405 of the first row 426 may fully or partially axially overlap the first backreaming cutting edge 435 of the second row 427, and the third backreaming cutting edge 437 of the second row 427 may fully or partially axially overlap the third backreaming cutting edge 407 of the first row 426.

Further, in one or more embodiments, axial overlap between the first row 426 and the second row 427 may provide protection to the body 425 of the cutter block 420. For instance, axial overlap may allow the cutting elements 700 of the first row 426 and the second row 427 to reduce exposure of the body 425 to the formation. As discussed herein, the body 425 may be formed from metal materials, matrix material, or other materials, and may include steel, tungsten carbide, other materials known in the art, or any combination of the foregoing.

In one or more embodiments, a first cutting element, e.g., a cutting element 700, on each of the first underreaming cutting edge 401 and the second underreaming cutting edge 402 may be on, in, or otherwise coupled to the body 425 of the cutter block 420 at substantially equivalent distances from the longitudinal axis 450. For instance, inner-most cutting elements, i.e., the cutting elements closest to the longitudinal axis 450, on each of the first underreaming cutting edge 401 and the second underreaming cutting edge 402 may be equidistant from the longitudinal axis 450. Such a configuration may reduce or even prevent undercutting of one or more of the cutting edges of the cutter block 420, which may result in early washout of one or more of the cutting edges of the cutter block 420.

As illustrated in FIG. 4, the first row 426 of cutting elements and the second row 427 of cutting elements of a cutter block may have similar profiles, and may potentially have identical profiles. In some embodiments, however, the first row of cutting elements and the second row of cutting elements of the cutter block may not be similar or identical. For example, in one or more embodiments, the first row of cutting elements may have a profile that includes one set of underreaming and backreaming cutting edges, while the second row of cutting elements may have a profile that includes a different set of underreaming and backreaming cutting edges. For instance, the first row of cutting elements may be similar to the profile shown in FIG. 2 and not have a stabilizer pad, while the second row of cutting elements may be similar to the profile shown in FIG. 3A, and have one or more stabilizer pads between underreaming and backreaming cutting edges. Such differences in profiles may also result in different diamond densities between the first row of cutting elements and the second row of cutting elements in a cutter block.

Figure 5:
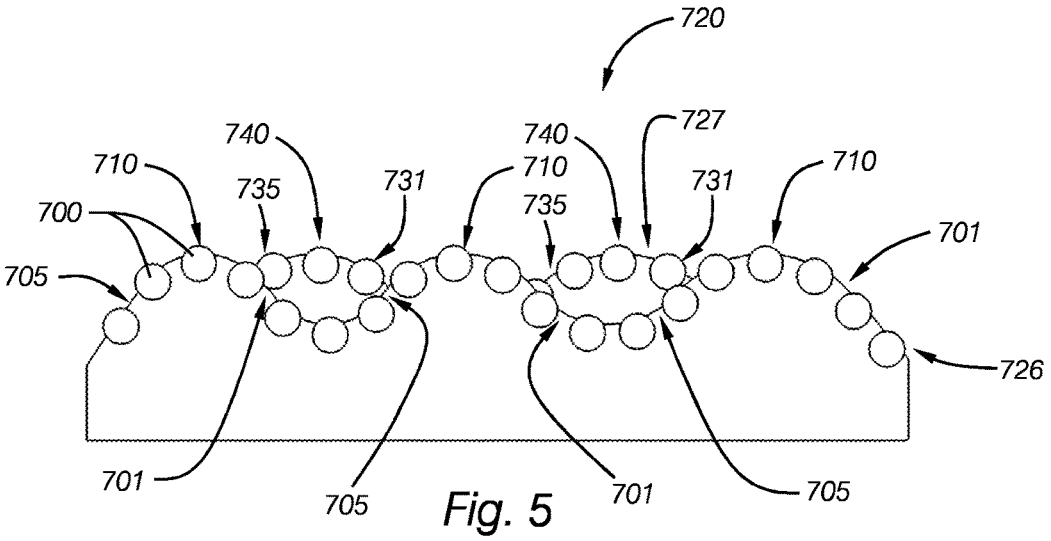
FIG. 5 is a side view of another cutter block, in accordance with embodiments disclosed herein.

In some embodiments, an underreaming cutting edge of a first row may be fully or partially axially aligned with a backreaming cutting edge or a stabilizer pad of a second row, or an underreaming cutting edge of a second row may be fully or partially axially aligned with a backreaming cutting edge or a stabilizer pad of a first row. Similarly, a backreaming cutting edge of a first row may be fully or partially axially aligned with an underreaming cutting edge or a stabilizer pad of a second row, or a backreaming cutting edge of a second row may be fully or partially axially aligned with an underreaming cutting edge or a stabilizer pad of a first row. FIG. 5, for instance, is a side view of a cutter block 720 having a first row 726 and a second row 727 of cutting elements 700. As shown in FIG. 5, peaks 710 of the profile of the first row 726 may be offset from peaks 740 of the profile of the second row 727. As a result, one or more backreaming cutting edges 705 of the first row 726 may be fully or partially axially aligned with one or more underreaming cutting edges 731 of the second row 727. Similarly, one or more underreaming cutting edges 701 of the first row 726 axially aligned, in whole or in part, with one or more backreaming cutting edges 735 of the second row 727.

The present disclosure is not limited to cutter blocks having configurations described herein. Other profiles and combinations, such as those described herein and those known in the art, may be used in accordance with embodiments described herein. For instance, the present disclosure is not limited to cutter blocks having a single row of cutting elements or having two rows of cutting elements on a cutter block. For example, in one or more embodiments, the cutter block may include three, four, five, or more rows (which may or may not be separated by a channel), including any combination of the rows of cutting elements or back-up cutting elements. As a result, the overall design of the body of the cutter block may vary accordingly. As used herein, the term "profile" may refer to dimensions, e.g., height, width, depth, contours, other configurations, or combinations of the foregoing of one or more portions of cutting edges formed by a surface and/or cutting elements of a cutter block.

According to additional and other aspects of the present disclosure, there is provided a method of drilling a well bore, the method including tripping a drilling tool assembly, e.g., the BHA 18 shown in FIG. 1A, into a well bore, e.g., within the well bore 14 of FIG. 1A or within the well bore annulus 22 shown in FIGS. 1B and 1C. The drilling tool assembly may include a drill bit, e.g., the drill bit 20 shown in FIG. 1A, and a downhole cutting apparatus. An example downhole cutting apparatus may include the expandable tool 500 shown in FIGS. 1B and 1C. In one or more embodiments, the downhole cutting apparatus may include a cutter block having a row of cutting elements. The row of cutting elements may have first and second underreaming cutting edges. The first and second underreaming cutting edges may be rotationally or laterally aligned within the same row of cutting elements. The method may also include actuating the drill bit, drilling a first portion of the well bore with the drill bit, and drilling a second portion of the well bore with the downhole cutting apparatus. In one or more embodiments, drilling a second portion of the well bore with the downhole cutting apparatus may include drilling the second portion of the well bore with the first underreaming cutting edge of the downhole cutting apparatus. The method may also include drilling a third portion of the well bore with the second underreaming cutting edge of the downhole cutting apparatus after the first underreaming cutting edge of the downhole cutting apparatus fails. Similarly, the method may include drilling a fourth portion of the well bore with the first backreaming cutting edge of the downhole cutting apparatus, and drilling a fifth portion of the well bore with the second backreaming cutting edge of the downhole cutting apparatus after the first backreaming cutting edge of the downhole apparatus fails. A method for drilling may also utilize one, but not both, of underreaming or backreaming cutting edges. For instance, the method for drilling may include drilling using backreaming edges to drill the second and third portions of the well bore.

According to another aspect disclosed herein, there is provided a method of manufacturing a cutter block, the method including forming a cutter block body including a first row of cutter element pockets. A plurality of cutting elements are coupled to the cutter block body and within the cutting element pockets. In one or more embodiments, the plurality of cutting elements may form a first underreaming cutting edge, a second underreaming cutting edge, and a first backreaming cutting edge between the first underreaming cutting edge and the second underreaming cutting edge.

Cutting element pockets may include indentations formed into a surface of the cutting block, e.g., on the first row 426 and/or on the second row 427 shown in FIG. 4, and which are configured to receive and retain cutting elements, e.g., cutting elements 700. As shown in FIG. 4, the cutting elements 700 may be positioned within cutting element pockets formed in the first row 426 and in the second row 427. Coupling the cutting elements to the cutter block body while in the cutting element pockets may include brazing the cutting elements into the cutting element pockets; however, the plurality of cutting elements in the cutting element pockets may be coupled to the cutter block body in any other manner known in the art.

A method for manufacturing a cutter block may also include forming a second row of cutting element pockets. The second row of cutting element pockets may be rotationally or laterally offset from the first row of cutting element pockets on the cutter block. A plurality of cutting elements may be coupled to the cutter block body and optionally within the cutting element pockets of the second row. The plurality of cutting elements of the second row may form a first underreaming cutting edge and a first backreaming cutting edge. In one or more embodiments, the plurality of cutting elements of the second row may form a second underreaming cutting edge and a second backreaming cutting edge.

Further, in one or more embodiments, forming the cutter block body may further include forming a stabilizer pad between an underreaming cutting edge and a backreaming cutting edge of at least one of the first row or the second row of cutting elements. Further, according to embodiments described herein, a backreaming cutting edge of the first row may axially overlap an underreaming cutting edge of the second row, such as shown in FIG. 5. The method may also include, forming the cutter block and/or coupling cutting elements to the cutter block such that a one or more back-up cutting elements trail cutting elements of one or more rows of cutting elements. Back-up cutting elements may be laterally or rotationally offset from a leading or primary row of cutting elements. In some embodiments, back-up cutting elements may have a partial face surface exposed, while leading or primary cutting elements may have a larger, and potentially full face surface, exposed. In some embodiments, back-up cutting elements may directly trail respective leading or primary cutting elements, while in other embodiments, back-up cutting elements may be fully or partially axially offset (e.g., between two leading or primary cutting elements).

It should be understood that while elements are described herein in relation to depicted embodiments, each element may be combined with other elements of other embodiments. For example, the elements or cutting profile depicted in or described in relation to FIG. 2A, may be combinable with any elements or cutting profile depicted in FIG. 1B, 1C, 3A, 3B, 4, or 5. Similarly, the elements depicted in or described in relation to FIG. 2B through FIG. 5 may be combinable with any elements depicted in or described in relation to other figures.

While embodiments of movable arms and cutting blocks have been primarily described with reference to well bore drilling operations, the devices described herein may be used in applications other than the drilling of a well bore. In other embodiments, movable arms and cutter blocks according to the present disclosure may be used outside a well bore or other downhole environment used for the exploration or production of natural resources. For instance, tools and assemblies of the present disclosure may be used in a well bore used for placement of utility lines, or other industries (e.g., aquatic, manufacturing, automotive, etc.). Accordingly, the terms "well bore," "borehole" and the like should not be interpreted to limit tools, systems, assemblies, or methods of the present disclosure to any particular industry, field, or environment.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value. Where a range of values includes various upper and/or lower limits, any two values may define the bounds of the range, or any single value may define an upper limit (e.g., up to 50%) or a lower limit (at least 50%).

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. It should be understood that "proximal," "distal," "uphole," and "downhole" are relative directions. As used herein, "proximal" and "uphole" should be understood to refer to a direction toward the surface, rig, operator, or the like. "Distal" or "downhole" should be understood to refer to a direction away from the surface, rig, operator, or the like.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole cutting apparatus comprising:

a cutter block having a first row of cutting elements positioned along at least one first surface and defining:

a first underreaming cutting edge;

a second underreaming cutting edge, and a first backreaming cutting edge between the first underreaming cutting edge and the second underreaming cutting edge.

2. The apparatus of claim 1, the first row or cutting elements further defining a second backreaming cutting edge above the first backreaming cutting edge.

3. The apparatus of claim 1, a profile of the first row of cutting elements including at least two peaks.

4. The apparatus of claim 3, the at least two peaks having a substantially equal height.

5. The apparatus of claim 1, a first angle defined between the first underreaming cutting edge and a longitudinal axis being less than a second angle defined between the second underreaming cutting edge and the longitudinal axis.

6. The apparatus of claim 1, the first row of cutting elements further defining at least one stabilizer pad between the first underreaming cutting edge and the first backreaming cutting edge.

7. The apparatus of claim 6, the at least one stabilizer pad having a height substantially equal to a height of at least two peaks of a profile of the first row of cutting elements.

8. The apparatus of claim 1, the cutter block having a second row of cutting elements laterally offset from the first row of cutting elements and along at least one second surface, the second row of cutting elements defining a first underreaming cutting edge and a first backreaming cutting edge.

9. The apparatus of claim 8, the second row of cutting elements further defining a second underreaming cutting edge and a second backreaming cutting edge.

10. The apparatus of claim 8, the first row of cutting elements including cutting elements on the first backreaming cutting edge of the at least one first surface that axially overlap cutting elements of the second row of cutting elements on the first underreaming cutting edge of the at least one second surface.

11. The apparatus of claim 1, the first row of cutting elements further defining:

a third underreaming cutting edge;

a second backreaming cutting edge between the second underreaming cutting edge and the third underreaming cutting edge; and a third backreaming cutting edge above the second backreaming cutting edge.

12. A method of drilling, comprising:

tripping a drilling tool assembly into a well bore, the drilling tool assembly including a drill bit and a downhole cutting apparatus having a cutter block with a row of cutting elements arranged along a first underreaming cutting edge, a second underreaming cutting edge, and a first backreaming cutting edge between the first underreaming cutting edge and the second underreaming cutting edge;

drilling a first portion of the well bore with the drill bit; and drilling a second portion of the well bore with the downhole cutting apparatus.

13. The method of claim 12, further comprising:

drilling a third portion of the well bore with the second underreaming cutting edge of the downhole cutting apparatus after failure of the first underreaming cutting edge of the downhole cutting apparatus.

14. The method of claim 12, the row of cutting elements being arranged along a second backreaming cutting edge above the first backreaming cutting edge.

15. The method of claim 14, further comprising:

drilling a third portion of the well bore with the first backreaming cutting edge of the downhole cutting apparatus.

16. The method of claim 15, further comprising:

drilling a fourth portion of the well bore with the second backreaming cutting edge of the downhole cutting apparatus after failure of the first backreaming cutting edge of the downhole apparatus.

17. The method of claim 12, wherein drilling the second portion of the wellbore includes radially moving the cutter block from a retracted state to an expanded state.

18. A method of manufacturing a cutter block, the method comprising:

forming a cutter block body with a first row of cutting element pockets along a first underreaming cutting edge, a second underreaming cutting edge, and a first backreaming cutting edge between the first and second underreaming cutting edges; and coupling a plurality of cutting elements to the cutter block body, and within the first row of cutting element pockets.

19. The method of claim 18, wherein forming the cutter block body includes forming a second row of cutting element pockets along a first underreaming cutting edge and first backreaming cutting edge, the method further comprising:

coupling a plurality of cutting elements to the cutter block body, and within the second row of cutting element pockets.

20. The method of claim 19, wherein forming the cutter block body includes at least one of:

forming the second row of cutting element pockets along a second underreaming cutting edge and a second backreaming cutting edge; or forming at least one stabilizer pad between the first underreaming cutting edge and the first backreaming cutting edge of at least one of the first row or the second row of cutting element pockets.

21. The method of claim 19, wherein the first underreaming cutting edge of the second row of cutting element pockets at least partially axially overlapping, in a rotated profile, the first backreaming cutting edge of the first row of cutting element pockets.

* * * * *